United States Patent [19]

Conner

[11] Patent Number: 4,637,235

[45] Date of Patent: Jan. 20, 1987

[54] OPTO ELECTRIC COMBINATION LOCK

[76] Inventor: Edward Conner, 170 NE. 18th St., Pompano Beach, Fla. 33060

[21] Appl. No.: 680,095

[22] Filed: Dec. 10, 1984

[51] Int. Cl.[4] ..... E05B 47/00

[52] U.S. Cl. ..... 70/277; 70/288; 70/289; 70/DIG. 51

[58] Field of Search ..... 70/277, 278, 282, 283, 70/287, 288, 289, 297, 298, DIG. 51, 266, 275; 250/215, 229

[56] References Cited

U.S. PATENT DOCUMENTS

| | | | |
|---|---|---|---|
| 2,008,150 | 7/1935 | Nelson | 70/DIG. 51 |
| 2,352,750 | 7/1944 | Witt | 70/287 |
| 3,733,862 | 5/1973 | Killmeyer | 70/277 |
| 3,889,501 | 6/1975 | Fort | 70/283 |
| 4,090,175 | 5/1978 | Hart | 340/164 R |
| 4,177,657 | 12/1979 | Aydin | 70/278 |

*Primary Examiner*—Robert L. Wolfe

*Attorney, Agent, or Firm*—Eugene F. Malin

[57] ABSTRACT

A opto-electric combination lock is described in which a single light emitting diode provides light to a phototransistor through a path which can be created by pulling and rotating a plurality of plunger assemblies. Each of the plunger assemblies have an opening therethrough which is placed in alignment with the path if that particular plunger assembly is pulled and rotated by the combination amount. The lock includes a switch for enabling the power supply only upon the pulling of a particular one of the plunger assemblies and further includes circuit means for actuating an event such as unlocking a door upon the creation of the light path.

6 Claims, 5 Drawing Figures

OPTO ELECTRIC COMBINATION LOCK

This invention relates to a actuating device and more particularly to a combination actuating device in which the combination is entered by pulling and rotating cylinders within the lock and further in which the triggering portion of the lock is light.

Combination locks and electrical locks are both well known in the prior art. The traditional combination lock is a type having a rotatable member which is indexed with a plurality of numbers and a number marker. The dial is rotated first in one direction until a predefined number is reached and then in another direction until a second number is reached. This may be repeated several times. Each time the predefined number is reached, one tumbler of the lock falls in place and when all of the tumblers are in place the lock can be opened. Each time a tumbler falls into place, a slight noise is made which can be detected. Hence, the traditional combination lock can be easily broken into, particularity if appropriate listening instruments are available.

Another type of lock which is become more common in more recent times, is the opto-electrical lock. This type of lock may be operated by inserting a key having a plurality of openings therein. When the key is inserted, it energizes power applied to a light source which directs light towards some light detectors. The key blocks the light paths for the areas where openings do not exist and allows light to pass through the openings for detection. The key holes thus act as a code to permit the lock to operate. This type of a lock has the advantage that it is silent and thus more difficult to break into. However, it has the disadvantage that a plurality of different light sources and optical detectors are required, thereby increasing the expense and leading to a greater probability of break down. Further, these type of locks require a key to be issued to each user, thereby increasing the expense, and keys tend to become lost or stolen, thereby increasing a breach of security. Typical of the optical electrical lock described is the one shown in U.S. Pat. No. 4,090,175 in the name of Robert Lee Hunt and entitled "Opto-electronic Lock Device".

It would be preferrable to have an opto-electrical lock of a combination type to avoid the ease of break-in and key problems. It further would be advantageous in such a lock to have only a single light source and light detector so that the costs can be minimized and the number of failing components minimized. The advantage of a combination rather than key lock is that anyone requiring access to the premises can be given the combination without fear of loss of keys. Further the lock should be such that the combination can be easily reprogrammed where desired to a different combination.

In accordance with one aspect of this invention, there is provided a combination actuating device comprising a plurality of movable cylinders, each having an opening through the center thereof and a frame for holding the cylinders and for allowing the cylinders to be moved according to a predefined combination to align the openings. In addition, there is provided light providing means and light detecting means for causing an actuation signal to be provided when light from said light providing means is provided thereto. The light providing means and light detecting means are positioned so that light is directed along a path from the providing means towards the detecting means through the cylinder openings when the cylinders have been moved in accordance with the predefined combination to be in alignment with the path.

One preferred embodiment of the present invention will hereafter be described, with specific reference being made to the following figures, in which.

Figure 1:
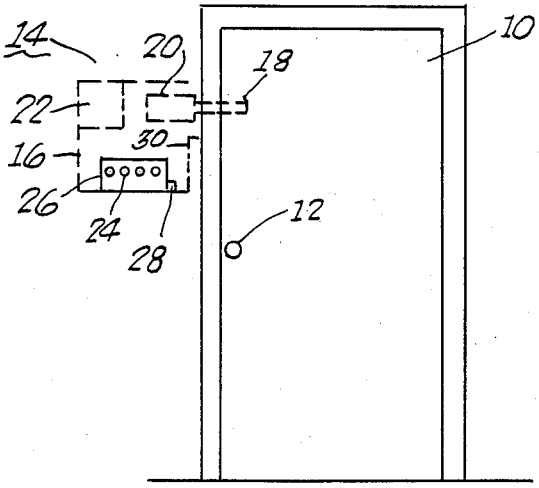
FIG. 1 shows the opto-electrical combination actuating device of the present invention used to lock a door.

Referring now to FIG. 1, a conventional door 10 is shown having a door handle 12 and positioned on a wall 14 separating two areas divided by wall 14. Where it is desired to limit the access through door 10, a combination lock 16 may be used. As shown in FIG. 1, combination lock 16 includes a normally extended barrel bolt 18 which can be retacted by solenoid 20. Lock 16 may be powered by a power supply 22. Upon properly setting the combination apparatus 24, a light path will exist between light providing means in the form of a light emitting diode (LED) 26 and light detecting means in the form of a photo transistor 28. Photo transistor 28 and the circuit elements on circuit board 30 then activates solenoid 20 to retract bolt 18. When bolt 18 is retracted, door 10 may be opened. Upon closing door 10, solenoid 20 may be deactivated and door 10 will be relocked. This may be accomplished by removing power from the circuit elements on board 30.

The barrel bolt 18 used to maintain door 10 in a locked position may be replaced by many similar type apparatus. For instance the signals from circuit board 30 may be used to enable handle 12 to be turned or may be utilized to engage handle 12 with conventional unlocking mechanisms so as to be operable.

Figure 2:
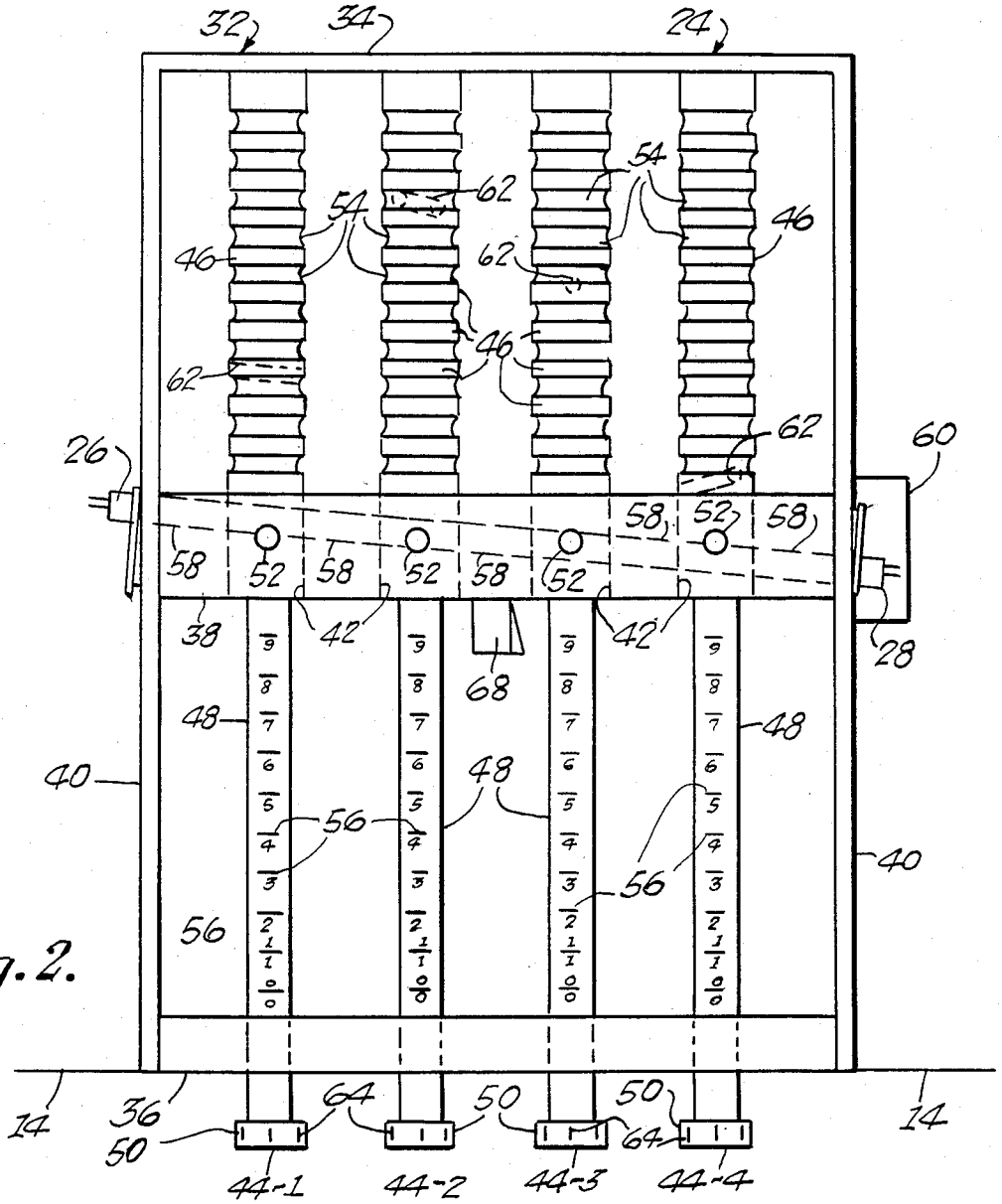
FIG. 2 shows a detailed diagram of the combination aspect of the device shown in FIG. 1.

Referring now to FIG. 2, the combination apparatus 24 is shown in more detail. Apparatus 24 includes a frame 32 having a back plate 34, a front plate 36, a center member 38 and left and right sides 40. Center member 38 may be a generally solid piece of material of, for instance, nylon or other plastic having four holes 42 in the direction generally from back plate 34 towards front plate 36. Four plunger assemblies or cylinders 44-1 through 44-4 are positioned one through each of the openings 42. The back of each plunger assembly 44 normally rests against back plate 34, which acts as a stop therefore. The end of each of the plunger assemblies 44 has a wide portion 46 and a narrower handle portion 48. Each of the handle portions 48 extends through front plate 36 and has a dial 50 affixed thereto which extends beyond front plate 36. Front plate 36 as seen in FIG. 2, may be mounted flush with wall 14.

Positioned above each of the openings 42 in center member 38 are indexing mechanisms 52. Each of the indexing mechanisms 52 may, for instance, be a ball bearing held compressed against wide portion 46 of plunger 44 by a set screw and spring assembly. The wide portion 46 of plunger assembly 44 is generally a cylinder of substantially the same width of openings 42 and adapted to be pulled through openings 42 by pulling on dial 50. Along the surface of each of the wide portions 46 of plungers 44 are a plurality of indexing cut-outs 54. Each of these may encircle the cylindrical wall of portion 46 and are adapted to be indexed by index mechanisms 52. In other words, as plunger 44 is pulled, indexing mechanism 52 rests in one of the indexing cut-outs 54. In this manner, the plungers may be pulled to precise indexed positions. As plunger 44 is pulled away from front plate 36, numbers 56 appearing on portion 48 will appear at the outer surface of face plate 36. Numbers 56 correspond to the particular one of the indexing cut-outs 54 in which indexing mechanism 52 is then engaged. Thus, each of the plunger assemblies 44-1 through 44-4 can be pulled to a different indexing number and this can be a part of the combination of combination apparatus 24.

Referring now to center member 38, LED 26 is positioned on one side of center member 38 and photo-transistor 28 is positioned on the opposite side. As seen in FIG. 2, LED 26 is positioned on the edge of member 38 towards back plate 34 and photo-transistor 28 is positioned towards front plate 36. An opening 58 through member 38 from LED 26 to photo-transistor 28 is shown in dashed lines and intersects each of the openings 42. Photo-transistor 28 may include a shield 60 around it to prevent any light from energizing transistor 28. The light provided by LED 26 is blocked by each of the wide portion cylinders 46 of plunger assembly 44. However, if the blockage could be eliminated, then the light from LED 26 would be directed against photo-transistor 28 to cause an optical circuit to be formed.

Each of the portions 46 include an opening 62 therethrough which may be positioned so that when indexing mechanism 52 engages one of the indexing cut-outs 54 the opening 62 is aligned with opening 58 through center member 38. Each of the openings 62 may be positioned in a manner so that the alignment with opening 58 occurs only upon the proper rotation of the plunger assemblies 44. For example, each of the plunger assemblies 44 may have additional indexing marks 64 which can be used to index the rotation of plunger assembly 44 to properly align the opening 62 with the opening 58. Thus, the combination for apparatus 24 may also include the amount of rotation required for each of the plunger assemblies 44. By providing path 58 and openings 62 at nonperpendicular angles, additional rotational combination valves are achieved.

Figure 3:
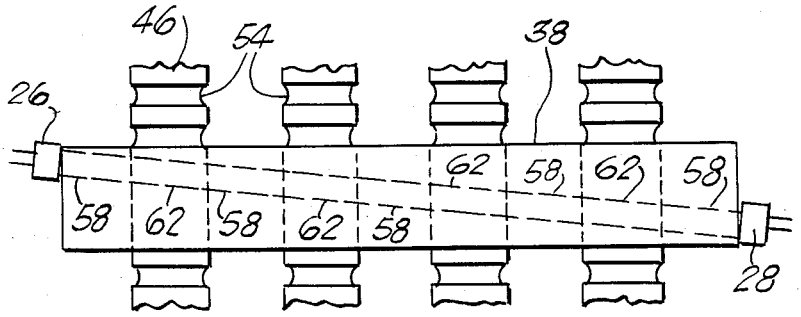
FIG. 3 shows the cylinders of FIG. 1 in the proper orientation to actuate the device.

Referring to FIG. 3, when the proper combination has been applied to combination assembly 24, that is, when each of the plunger assemblies 44-1 through 44-4 have been both pulled to the proper position and rotated to the proper position, a clear light path through openings 58 and 62 will exist between LED 26 and photo-transistor 28. This path will complete the optical circuit to allow an actuation to occur. The remainder of the actuation circuit is described hereafter with respect to FIG. 5.

Figure 4:
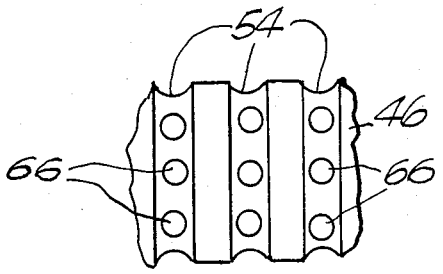
FIG. 4 shows an enhanced embodiment of the cylinder mechanism of FIGS. 2 and 3.

Referring to FIG. 4, each of the indexing cut-outs 54 may also include an indexing dimple 66 to allow indexing mechanism 52 to mark the actual rotation of plunger assemblies 44. Alternately, the wide portion of cylinder 46 may only include the dimples 66 intead of indexing cutouts 54.

Referring again to FIG. 2, switch means for energizing said light providing means and said light detecting means 68 is positioned on the side of center member 38 adjacent to one of the plunger assemblies 44, such as assembly or cylinder 44-3. As plunger assembly 44-3 is moved in a direction towards front plate 36, the side thereof closes switch means 68. Switch means 68 may be coupled in circuit with power supply 22 to cause it to provide power to LED 26 and the other circuit components only upon the closure of switch means 68. In this manner this will increase the life of the electronic components, particularly the life of LED 26.

Figure 5:
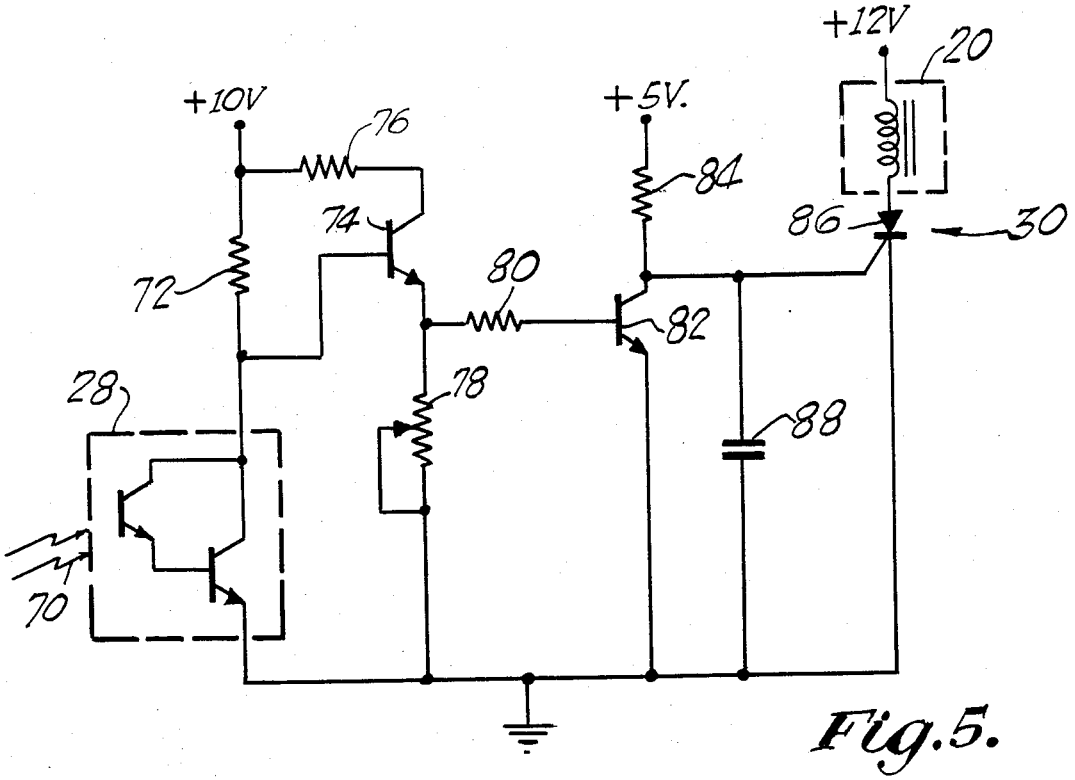
FIG. 5 shows an electric circuit used to cause the actuation upon proper alignment of the cylinders shown in FIG. 3.

Referring now to FIG. 5, the electronic components used in conjunction with the lock will be described. These components include the photo-transistor 28 and the various components on circuit board 30. Reference to the voltages applied to the circuits shown in FIG. 5 are provided from power supply 22 which may be any conventional power supply capable of providing the noted voltages.

Photo-transistor 28 receives light 70 from LED 26. The emitter of transistor 28 is coupled to ground and the collector of photo-transistor 28 is coupled through resistor 72 to a source of +10 volts. The junction between the collector of photo-transistor 28 and resistor 72 is coupled to the base of transistor 74. The collector of transistor 74 is coupled through resistor 76 to +10 volts and the emitter of transistor 74 is coupled through potentiometer 78 to ground. The emitter of transistor 74 is also coupled through resistor 80 to the base of transistor 82. The emitter of transistor 82 is coupled to ground and the collector of transistor 82 is coupled through resistor 84 to +5 volts.

The collector of transistor 82 is further coupled to the control electrode of SCR device 86 to render it conductive. The cathode of a SCR device 86 is coupled to ground and the anode of SCR device 86 is coupled through one coil of solenoid 20 to a source of +12 volts. A capacitor 88 is coupled between control electrode of SCR 86 and ground. Thus, when SCR 86 is rendered conductive, current flows through solenoid 20 causing an actuation of bolt 18 seen in FIG. 1.

Connected in this manner each time the openings 62 are aligned with the openings 58 by the proper combination being configured into lock 16 the light applied to photo-transistor 28 causes SCR 86 to conduct and actuate solenoid 20. Solenoid 20 then draws bolt 18 bak, thereby unlocking door 10.

Means (not Shown) may also be provided to automatically reset the plunger assemblies 44 upon either opening or closing the door 10. For example springs may be attached to plunger assemblies 44 and indexing mechanism 52 may also function as a catch. Upon sensing closure of door 10 after being opened, the catch portion of mechanism could be released and the springs would return plunger assemblies 44 to a home position. Appropriate grooving in the side of plunger assemblies could also cause rotation back to the home position. Also, a buzzer could be included which is only shut off by the operator of lock 16 manually resetting plunger assemblies 44.

One could easily change the combination of lock 16 by either replacing or rearranging the plunger asemblies 44. This feature is particularly useful in high security areas where knowledge of the combination is to be limited.

What is claimed is:

1. A combination actuating device, comprising:

a plurality of moveable cylinders, each having an opening through the center thereof;

a frame for holding said cylinders and for allowing said cylinders to be moved according to a predefined combination to align said openings;

light providing means; and light detecting means for causing an actuation signal to be provided when light from said light providing means is provided thereto;

said light providing means and light detecting means being positioned so that light is directed along a path from said light providing means towards said light detecting means through said cylinder openings when said cylinders have been moved by a predefined rotational angle and a predefined longitudinal distance in accordance with said predefined combination to be in alignment with said path.

2. The invention according to claim 1 wherein said path is at a non-perpendicular angle to said cylinders.

3. The invention according to claim 1 wherein said frame means includes means to index the movement of said cylinders.

4. The invention according to claim 1 wherein said device further includes switch means for energizing said light providing means and said light detecting means.

5. The invention according to claim 4 wherein said switch means is activated by moving one of said cylinders.

6. The invention according to claim 5 wherein said switch means is positioned in said frame.

* * * * *